US006146206A

United States Patent [19]

Konno et al.

[11] Patent Number: 6,146,206

[45] Date of Patent: Nov. 14, 2000

[54] POWER-SUPPLY CONNECTOR

[75] Inventors: Takeshi Konno; Shinichi Asano, both of Ibaraki-Ken, Japan

[73] Assignee: Mitsumi Electric Co., Ltd., Japan

[21] Appl. No.: 09/305,012

[22] Filed: May 4, 1999

[30] Foreign Application Priority Data

May 14, 1998 [JP] Japan ..... 10-150688

[51] Int. Cl.[7] ..... H01R 33/95

[52] U.S. Cl. ..... 439/621; 439/924.2

[58] Field of Search ..... 439/621, 622, 439/366, 447, 911, 299, 300, 924.2

[56] References Cited

U.S. PATENT DOCUMENTS 5,281,171 1/1994 Job ..... 439/621
5,334,048 8/1994 Bowers et al. ..... 439/567
5,364,287 11/1994 Weber ..... 439/358
5,391,098 2/1995 Ohashi ..... 439/830
5,779,197 7/1998 Kim ..... 248/27.1
5,816,858 7/1998 Kazarian et al. ..... 439/621

*Primary Examiner*—Brian Sircus
*Assistant Examiner*—Chandrika Prasad
*Attorney, Agent, or Firm*—Morrison Law Firm

[57] ABSTRACT

A slippage prevention piece integrally formed onto a main socket unit of a power supply connector socket blocks undesired removal of a fuse from the power supply connector. A locking mechanism is included in the connector socket and connector plug to more reliably hold the power supply connector intact. The locking mechanism further aids in preventing the removal of the fuse from the power supply connector. The fuse is prevented from accidental removal by vibrations or contact with external objects. The result is a power supply connector having a fuse which is securely held in place.

4 Claims, 4 Drawing Sheets

POWER-SUPPLY CONNECTOR

BACKGROUND OF THE INVENTION

The present invention relates to a power-supply connector. More specifically, the present invention relates to a power-supply connector mounted on a printed circuit substrate of a device.

Referring to FIGS. 6 and 7, a conventional power-supply connector, having a fuse 6A, is used, for example, in car audio equipment. A connector plug is mounted on an end of a printed circuit substrate 2A of a car audio chassis 1A. A plug opening 3A and a fuse opening 4A are exposed from a rear surface of car audio chassis 1A.

The connector plug includes a main plug unit 5A molded from an insulative resin. A connector socket used for external connections inserts into plug opening 3A of main plug unit 5A. A blade fuse 6A inserts into fuse opening 4A.

A plurality of connection pins 7A are bent in an L shape to form first ends 7*a* positioned inside plug opening 3A of main plug unit 5A. Second ends 7*b* of connection pins 7A are electrically connected to signal line conductors of printed circuit substrate 2A.

Contact ends 11*a* and 12*a* of ground terminals 11A (power supply terminals) and plug terminals 12A (power supply terminals) are positioned inside fuse opening 4A. Contact ends 11*a* and 12*a* connect to a pair of conducting blades 6*a* and 6*b* of blade fuse 6A. Connection terminals 11*b* and 12*b* of ground terminals 11A and plug terminals 12A electrically connect with contact conductors 10A, arranged at different positions from the signal line conductors described above.

In conventional power supply connectors with fuses having the structure described above, conductor blades 6*a* and 6*b* of blade fuse 6A inserts into fuse opening 4A to prevent overcurrents from flowing when a short-circuit takes place.

However, vibration of the vehicle may cause blade fuse 6A to slip out from fuse opening 4A. If conductor blades 6*a* and 6*b* unexpectedly slip out from fuse opening 4A the power supply voltage to the printed circuit substrate 2A is removed. The lack of a power supply voltage stops the operation of the car audio equipment.

Also, an electrical shock may result if a hand or the like contacts the conductor blades 6*a* and 6*b* of blade fuse 6A when it has slipped out from fuse opening 4A.

OBJECTS AND SUMMARY OF THE INVENTION

It is an object of the present invention is to provide an electrical connector which overcomes the problems of conventional electrical connectors described above.

It is a further object of the present invention to provide a power-supply connector being inexpensive to produce.

It is still a further object of the present invention to provide a power-supply connector having a blade fuse where the blade fuse does not unexpectedly slip out during use.

Briefly stated, the present invention provides a slippage prevention piece integrally formed onto a main socket unit of a power supply connector socket to block undesired removal of a fuse from the power supply connector. A locking mechanism is included in the connector socket and connector plug to more reliably hold the power supply connector intact. The locking mechanism further aids in preventing the removal of the fuse from the power supply connector. The fuse is prevented from accidental removal by vibrations or contact with external objects. The result is a power supply connector having a fuse which is securely held in place.

According to an embodiment of the present invention, there is provided a power supply connector comprising a connector socket, a connector plug mounted on a circuit board, a plug opening in the connector plug to receive the connector socket, a fuse opening in the connector plug permitting a fuse to be at least partially inserted therein, the plug opening and the fuse opening facing in a first direction, the connector socket mating with the connector plug from a second opposite direction, a slippage prevention piece affixed to the connector socket, and the slippage prevention piece covering at least a portion of the fuse when the connector socket and the connector plug are mated, whereby accidental removal of the fuse from the fuse opening is prevented.

In order to achieve this object, the present invention proposes a power-supply connector wherein a main plug unit of a connector plug molded from an insulative resin is formed with a plug opening, into which a socket of a connector socket is inserted, and a fuse opening, into which a fuse is inserted. The main plug unit is mounted on a printed circuit substrate. A slippage-prevention piece projects downward in front of the blade fuse. The slippage-prevention piece is molded integrally with a resin main socket unit of the connector socket.

In one embodiment of the present invention, the following two structures are present:

1) A structure in which the slippage-prevention piece is formed with an exposure window exposing a rating indicator for the blade fuse to the outside; and 2) A structure in which the main plug unit and the main socket unit are locked together by a lock claw disposed on one of these two elements, and a lock handle disposed on the other element, the lock handle engaging with the lock claw.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
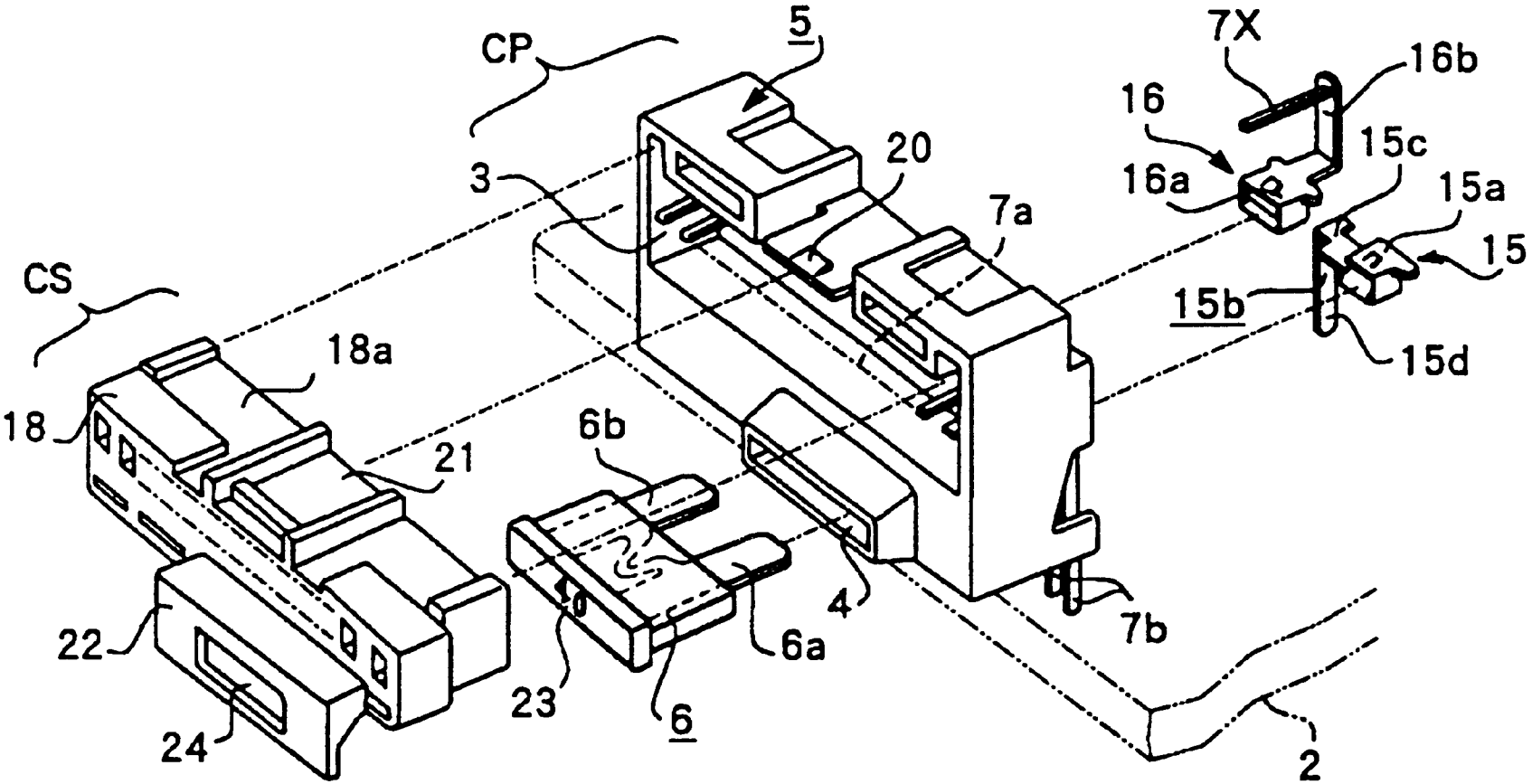
FIG. 1 is an exploded perspective drawing of the entire power-supply connector.
Figure 2:
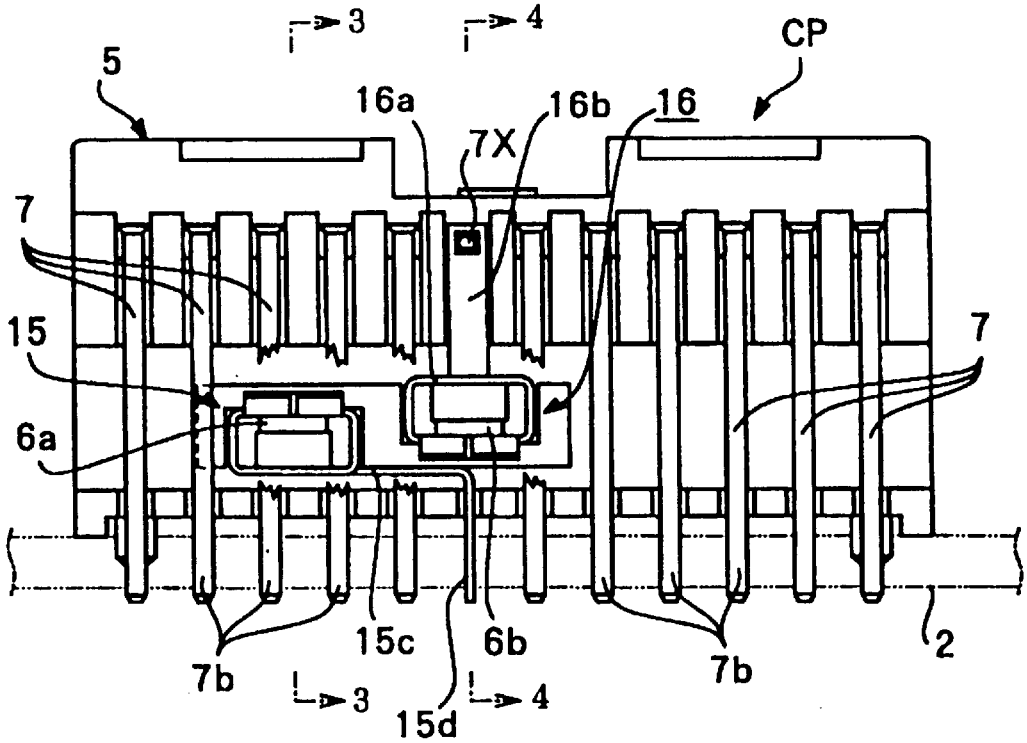
FIG. 2 is a partially cut-away rear-view drawing of the power-supply connector of FIG. 1.
Figure 3:
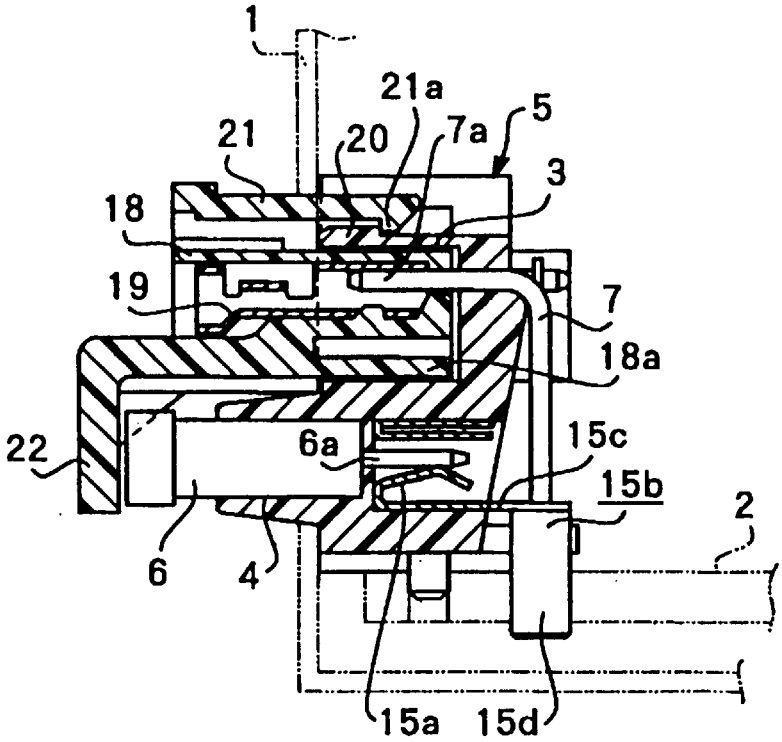
FIG. 3 is a cross-section drawing along the 3—3 line in FIG. 2.
Figure 4:
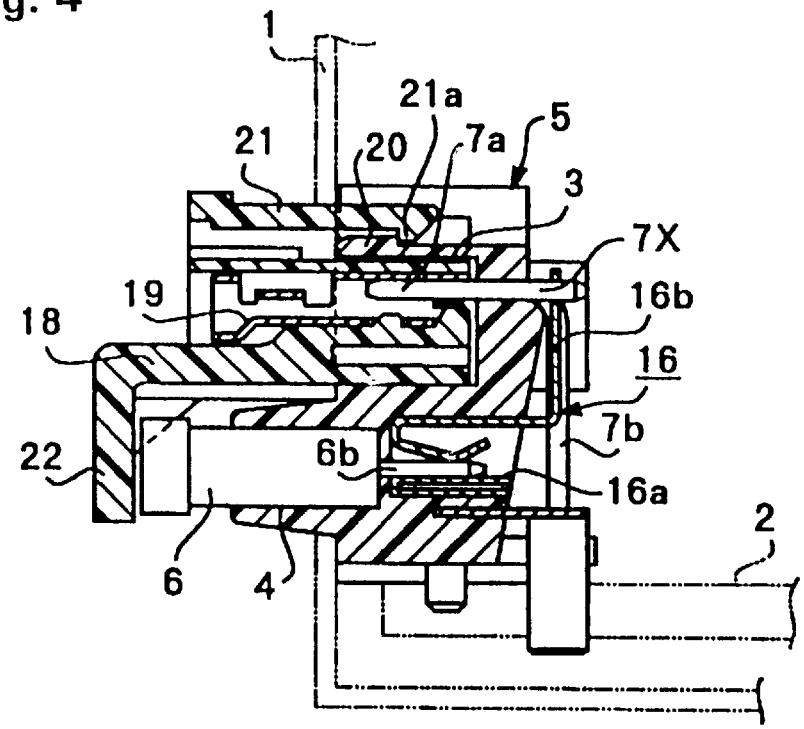
FIG. 4 is a cross-section drawing along the 4—4 line in FIG. 2.
Figure 5:
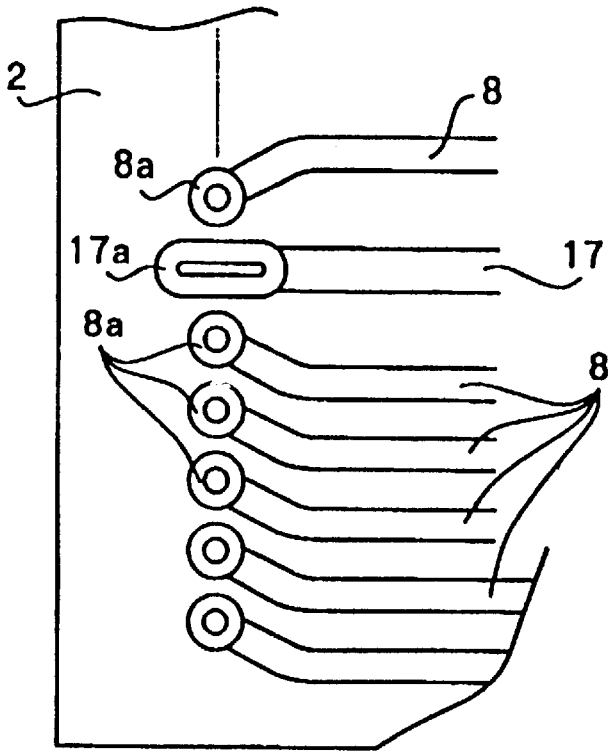
FIG. 5 is a detail of a schematic plan drawing of a printed circuit substrate on which the power-supply connector is mounted.
Figure 6:
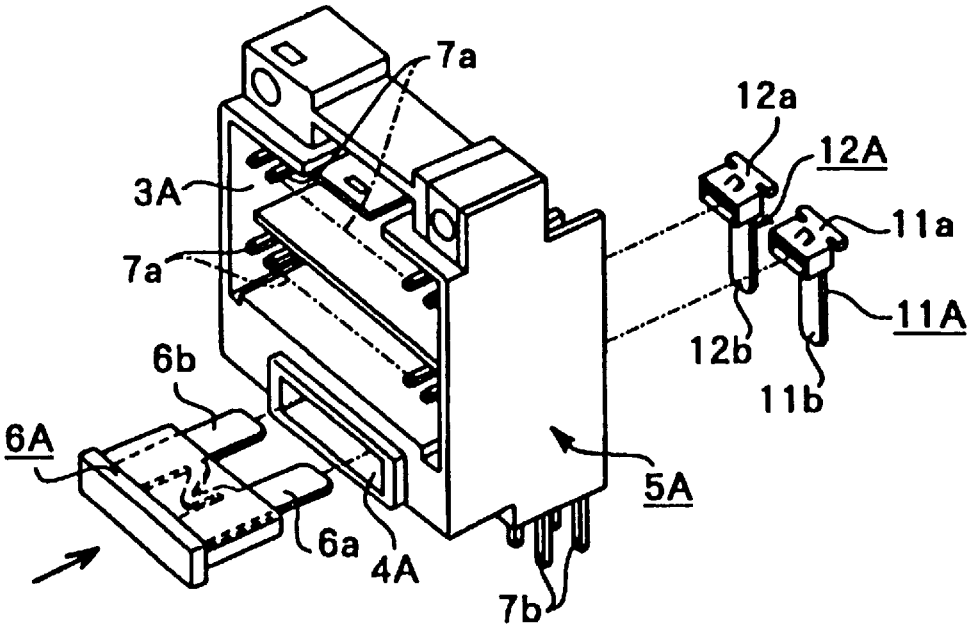
Fig. 6 PRIOR ART
FIG. 6 is an exploded perspective drawing of a conventional power-supply connector.
Figure 7:
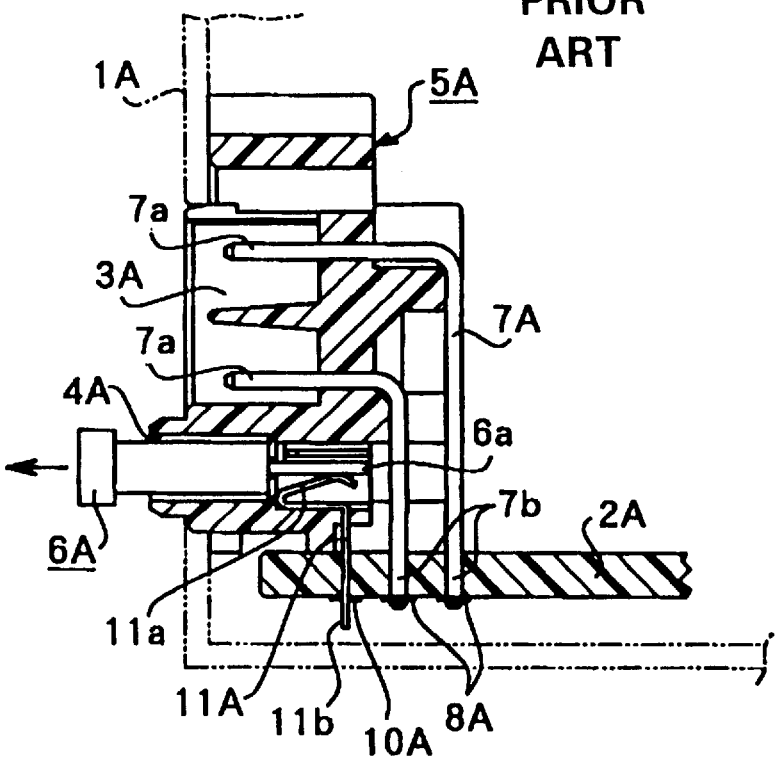
Fig. 7 PRIOR ART
FIG. 7 is a cross-section drawing of the conventional power-supply connector of FIG. 6.

Referring to FIGS. 1 through 5, a main plug unit 5 of a connector plug CP is mounted at an end of printed circuit substrate 2 of a car audio chassis 1. A connector socket CS, providing external connections, connects to a plug opening 3 of main plug unit 5. Plug opening 3 is exposed to an outside rear surface of car audio chassis 1.

First ends 7*a* of a plurality of L-shaped connection pins 7 are positioned inside plug opening 3 of main plug unit 5. Second ends 7*b* of connection pins 7 are soldered to lands 8*a* corresponding to signal line conductors 8 on printed circuit substrate 2.

A blade fuse 6, having a pair of conductor blades 6*a* and 6*b*, inserts into a fuse opening 4 of main plug unit 5. Main plug unit 5 is preferably molded from an insulative resin. A pair of power supply terminals 15 and 16 are disposed in fuse opening 4 to contact conductor blades 6*a* and 6*b* of blade fuse 6.

Power-supply terminal 15 includes a contact terminal 15*a* which is bent to resiliently contact conductor blade 6*a*. A contact terminal extension 15*b*, integrally formed with an end of contact terminal 15*a*, is soldered to one of lands 8*a* of signal line conductors 8 described above. Contact terminal extension 15*b* includes an offset extension 15*c*, extending roughly horizontally toward laterally adjacent power supply terminal 16 of main plug unit 5, and a connection end 15*d*, continuous with the end of offset extension 15*c*, extending in a roughly perpendicular direction. A lower end of connection end 15*d* is soldered to one of lands 8*a* of printed circuit substrate 2.

Power supply terminal 16 includes a connection end 16*a*, which contacts a conductor blade 6*b* of blade fuse 6. A connection end 16*b* has a roughly perpendicular bend pointing upward at a rear end of connection terminal 16*a*. A connection pin 7X, which is one of connection pins 7, is soldered to connection end 16*b*. Thus connection pin 7X is electrically continuous with a power supply conductor 17 of printed circuit substrate 2 through power-supply terminal 16, blade fuse 6, and power-supply terminal 15.

A socket 18*a* of a main socket unit 18 of connector socket CS, is inserted into plug opening 3 described above. When socket 18*a* is completely inserted into plug opening 3, connection pins 7 contact corresponding connectors 19 of connector socket CS. Connector socket CS is preferably constructed of an insulating resin.

A lock handle 21, integrally molded on an upper section of main socket unit 18, engages a lock claw 20 at an end surface of main plug unit 5. Thus, when connector socket CS connects with connector plus CP, engagement between lock claw 20 and an end hook 21*a* of lock handle 21 locks connector socket CS into connector plug CP of printed circuit substrate 2.

A slippage prevention piece 22, integrally molded to a front section of main socket unit 18, hangs down in front of blade fuse 6. An exposure window 24 on slippage prevention piece 22 exposes a property of blade fuse 6, such as a rating indicator 23.

With the structure described above, the power-supply connector according to the embodiment of the present invention shown in the drawings allows the signal harness and the power-supply harness connected to connector socket CS to connect to the corresponding power-supply conductor and signal line conductors 8 on printed circuit substrate 2 with connector plug CP.

When connector plug CP and connector socket CS are connected engagement of lock handle 21 with lock claw 20 maintains a locked state between connector plug CP and connector socket CS. Furthermore, blade fuse 6 may slip out of fuse opening 4 due to vehicle vibration, contact from external objects, and the like. With slippage prevention piece 22 positioned in front of blade fuse 6, the slipping out of blade fuse 6 from fuse opening 4 is prevented. Slippage prevention piece 22 prevents the undesired disconnection of a power supply from the electrical component and also prevents electrical shocks caused by the exposure of conductor blades 6*a* and 6*b*.

As the description above makes clear, the power-supply connector of the present invention prevents the blade fuse from accidentally slipping out by simply having slippage prevention piece 22 formed integrally with the main socket unit 18. Electrical shock accidents and power outages are prevented.

In one embodiment of the present invention, the current rating of blade fuse 6 easily externally inspected.

In another embodiment of the present invention, lock handle 21 maintains a locked state so that blade fuse 6 is more reliably prevented from slipping out.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A power supply connector comprising:

a connector socket;

a connector plug mounted on a circuit board;

a plug opening in said connector plug to receive said connector socket;

a fuse opening in said connector plug permitting a fuse to be at least partially inserted therein;

said plug opening and said fuse opening facing in a first direction;

said connector socket mating with said connector plug from a second opposite direction;

a slippage prevention piece affixed to said connector socket;

said slippage prevention piece covering at least a portion of said fuse when said connector socket and said connector plug are mated, whereby accidental removal of said fuse from said fuse opening is prevented;

said connector plug having at least one plug contact electrically contacting said circuit board; and said connector socket having at least one socket contact electrically contacting said at least one plug contact when said connector socket is mated with said connector plug.

2. A power supply connector according to claim 1, further comprising:

an exposure window in said slippage prevention piece; and said exposure window providing a view of at least a portion of said fuse from a position external to said power supply connector, whereby a property of said fuse is visible.

3. A power supply connector according to claim 1, further comprising locking means to lock said connector socket and said connector plug when said connector socket is mated with said connector plug.

4. A power supply connector according to claim 3, wherein said locking means includes a lock claw disposed on one of said connector socket and said connector plug and a lock handle disposed on the other of said connector socket and said connector plug.

* * * * *